US006895660B2

(12) United States Patent
Chu et al.

(10) Patent No.: US 6,895,660 B2
(45) Date of Patent: May 24, 2005

(54) MANUFACTURING METHOD OF OVER-CURRENT PROTECTION DEVICES

(75) Inventors: Edward Fu-Hua Chu, Taipei (TW); David Shau-Chew Wang, Taipei (TW); Chih-Ming Yu, KaoHsiung (TW)

(73) Assignee: Polytronics Technology Corporation, Hsinchu (TW)

( * ) Notice: Subject to any disclaimer, the term of this patent is extended or adjusted under 35 U.S.C. 154(b) by 113 days.

(21) Appl. No.: 10/331,749

(22) Filed: Dec. 30, 2002

(65) Prior Publication Data

US 2003/0121141 A1 Jul. 3, 2003

(30) Foreign Application Priority Data

Dec. 31, 2001 (TW) ..... 90133499 A

(51) Int. Cl.[7] ..... H01C 7/02; H01C 7/04

(52) U.S. Cl. ..... 29/612; 29/610; 29/610.1; 29/611; 338/203; 338/235; 361/103

(58) Field of Search ..... 29/612, 610, 610.1, 29/611; 338/203, 235; 361/103

(56) References Cited

U.S. PATENT DOCUMENTS 4,907,340 A * 3/1990 Fang et al. ..... 29/610.1

5,849,129 A * 12/1998 Hogge et al. ..... 156/244.27

6,130,597 A * 10/2000 Toth et al. ..... 338/22 R

OTHER PUBLICATIONS

"Plastics Engineering", 2nd Edition, Crawford, R.S., pp. 30–31, Oxford: Pergamon, 1987.

* cited by examiner

*Primary Examiner*—Carl J. Arbes
*Assistant Examiner*—Tim Phan
(74) *Attorney, Agent, or Firm*—Seyfarth Shaw LLP

(57) ABSTRACT

The present invention discloses a manufacturing method of an over-current protection device, characterized in that the PTC plaque is conducted by punching under frozen state to form the over-current protection devices so as to reduce the heating and temperature rising in the PTC plaque due to punching and temperature difference between the metal foil and the conductive composite material. Relatively, the deformation and stress of the over-current protection device caused by punching will also be reduced. Therefore, there is no need for additional process to increase the temperature sensitivity and electrical property stability of the over-current protection device.

10 Claims, 3 Drawing Sheets

MANUFACTURING METHOD OF OVER-CURRENT PROTECTION DEVICES

CROSS REFERENCE TO RELATED DOCUMENT

The present application claims the benefit of Taiwanese Application, TAIWAN 090133499, which was filed on 31st Dec. 2001.

BACKGROUND OF THE INVENTION

1. Field of the Invention

The invention relates to a manufacturing method of over-current protection devices.

2. Background of the Invention

The conventional over-current protection device 10, as shown in FIG. 1, includes a current sensing element 11, an upper electrode foil 12 and a lower electrode foil 13. Because the characteristic of the resistance value of the current sensing device 11 is very sensitive to the temperature variation, such device is now widely used to protect the battery or circuit devices.

Presently, the general current sensing element 11 is formed of a conductive material with positive temperature coefficient (PTC), which includes a polymer and conductive filler. The resistance value of the PTC conductive composite material is very sensitive to temperature variation. That is, under normal operation, the resistance may remain at extremely low value in order for the circuit to operate normally. But when the over-current or over-temperature phenomenon happens, the resistance value will rise to a high resistance state instantly (at least $10^4$ ohm), and the excess current will be eliminated reversely to achieve the object of protecting the battery or circuit devices.

The conventional manufacturing method of the over-current protection device is to first mix at least one polymer and conductive filler sufficiently and uniformly to form a PTC conductive composite material. Next, the PTC conductive composite material acting as the current sensing element are pressed with two metal foils to form a PTC plaque. Then, the PTC plaque is radiated with radioactive rays to conduct the cross-linking reaction in the conductive composite material of the PTC plaque for enhancing the electrical property. Finally, the PTC plaque is punched to form a plurality of over-current protection devices.

However, the PTC devices are prepared by stamping operation which results in temperature rise of the stamping mold and a local heating at the newly formed PTC cutting surface. After stamping, the PTC device cools down to room temperature. Since PTC device consists of metal foil and PTC conductive composite material, and the thermal expansion coefficients of the metal foil and the PTC conductive composite material are quite different from each other, the shrinkage of the metal foil and the PTC conductive composite material will be different. After a cycle of stamping heating and room temperature cooling internal stress is generated inside the PTC device and a deformation of the PTC plaque could be observed. The stress generated in the PTC conductive composite material and the metal foil may be expressed as the following equation: $\sigma=c(\alpha_{metal}-\alpha_{PTTC})\times\Delta T$, wherein $\sigma$ represents the stress difference between the PTC plaque and the metal foil due to expansion and shrinkage, c is a constant, $\alpha_{metal}$ is the thermal expansion coefficient of the metal foil , $\alpha_{PTTC}$ is the thermal expansion coefficient of the PTC conductive composite material, and $\Delta T$ represents the temperature difference between the metal foil and the PTC conductive composite material caused by a rise in temperature from the local heating during punching. From the above equation, the higher the temperature difference between the metal foil and the PTC conductive composite material due to punching is, the greater the stress generated inside the PTC plaque due to expansion and shrinkage, and also the larger the deformation. Therefore, after punching of the PTC plaque, stress will be generated inside the formed over-current protection device due to thermal expansion. The heated PTC conductive composite material will extrude from the edges of the upper and lower electrode foils due to expansion, and result in the warpage on the edges of the upper and lower electrode foils due to the expansion of the FTC conductive composite material, which will cause an unexpected damage on the over-current protection device.

In order to solve the described defects of the over-current protection device due to stress and heating expansion, U.S. Pat. No. 6,130,597 described a manufacturing method for the over-current protection device, which conducts a heat treatment on the formed over-current protection device after punching to compensate the defects in the over-current protection device resulting from the heating due to punching. However, the conventional method will complicate the original process along with a drawback of increasing device resistance. In addition, the conventional heat treatment method could not completely compensate for the defects resulting from internal stresses.

Following the enhanced precision of the portable electronic product, slight defects on the material will also influence the normal operation of the electronic product. Thus, it is necessary to find a solution that focuses on solving such problem.

BRIEF DESCRIPTION OF THE INVENTION

The first object of the invention is to provide a manufacturing method of the over-current protection device, which can avoid the defects of deformation or increasing internal stress caused by local heating during punching, in order to increase the temperature sensitivity and electrical property stability of the over-current protection device.

To achieve the above-mentioned objects and avoid the drawbacks in the prior art, the invention discloses a manufacturing method of the over-current protection device, including the steps of:

- providing a PTC component, where the PTC component includes a conductive composite material with positive temperature coefficient and two metal foils;
- freezing the PTC plaque to a low temperature state;
- punching the PTC plaque to form a plurality of over-current protection devices; and
- irradiating the formed over-current protection device with radioactive rays to make the conductive composite material conduct a cross-linking reaction.

Furthermore, the manufacturing method of the over-current protection device of the invention can use the irradiation with two-stage radioactive rays, which conducts the first stage of radioactive ray irradiation for the PTC plaque before punching to make the PTC conductive composite material conduct an initial cross-linking reaction. After punching of the PTC plaque, the second stage of radioactive ray irradiation is conducted to make the PTC conductive composite material conduct further cross-linking reaction so as to increase the temperature sensitivity and electrical property stability thereof.

That is, the manufacturing method of the over-current protection device disclosed in the invention is characterized in that the PTC plaque is conducted with punching under frozen state to form the over-current protection devices so as to minimize the heating and temperature rising in the PTC plaque due to punching and the temperature difference between the metal foil and the conductive composite material. That is, the parameter $\Delta T$ in the above equation will be reduced. Relatively, the deformation and stress of the over-current protection device caused by punching will also be reduced. Therefore, there is no need for additional process to increase the temperature sensitivity and electrical property stability of the over-current protection device.

BRIEF DESCRIPTION OF THE DRAWINGS

The present invention will be described according to the appended drawings in which.

DESCRIPTION OF PREFERRED EMBODIMENTS

Figure 1:
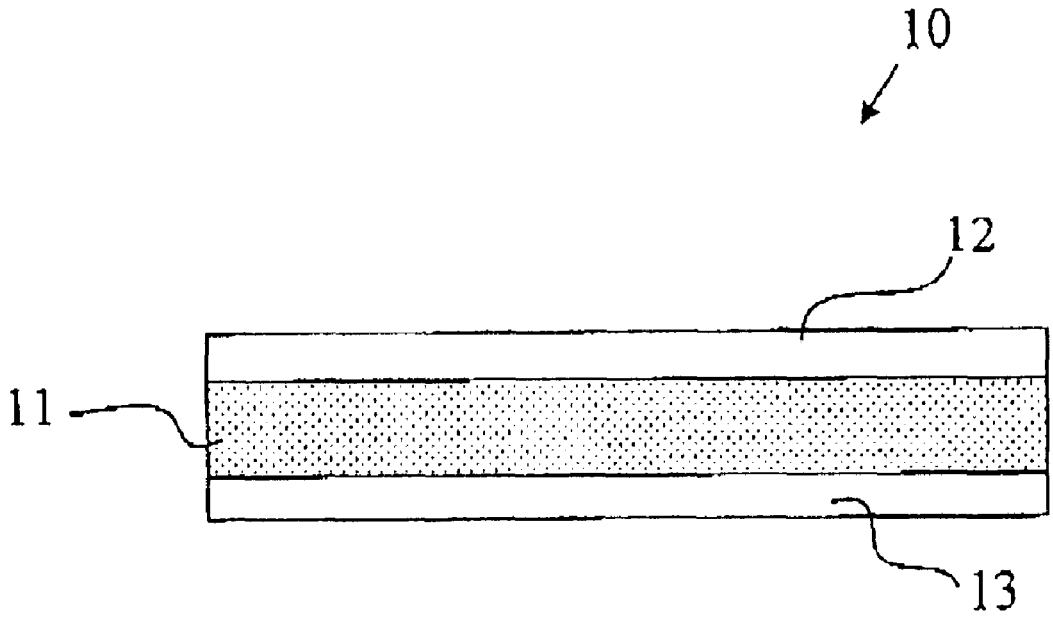
FIG. 1 (Prior art)
FIG. 1 shows a cross-sectional diagram of the over-current protection device of the present invention.

The over-current protection device 10 used in the invention, as shown in FIG. 1, includes a current sensing element 11, an upper electrode foil 12 and a lower electrode foil 13. The current sensing element 11 is formed of a conductive composite material with positive temperature coefficient, which includes at least one polymer and conductive filler. The upper electrode foil 12 and the lower electrode foil 13 are adhered on both sides of the current sensing element 11.

The polymer used in the PTC conductive composite material includes at least one type of crystallized or amorphous polymer, such as polyethylene, polypropylene, polyoctenylene and the mixture thereof.

The conductive filler is dispersed in the polymer and is selected from the group consisting of carbon black, metal particles, graphite, ceramic powder and the mixture thereof. In order to enhance the toughness, conductivity and temperature sensitivity of the current sensing element 11, another additive may be added in the PTC conductive composite material to enhance the physical property. The additive includes a photo initializer, cross-linking agent, non-conductive filler, coupling agent, dispersing agent, tranquilizer or anti-oxidant, etc.

In a preferred embodiment of the invention, the polymer, conductive filler, non-conductive filler and additive are conducted first by initial mixing and smashing. Normally, the weight percentage of the polymer is between 20% to 80%, preferably between 30% to 70%; the weight percentage of the conductive filler is between 20% to 90%, preferably between 30% to 70%; the weight percentage of the non-conductive filler is between 0.1% to 10%, preferably between 0.5 to 5%. Then, the above-mentioned mixture is conducted by mixing under high temperature to form a PTC conductive composite material where the mixing temperature is between 140° C. to 250° C., preferably between 180° C. to 230° C.

Figure 2:
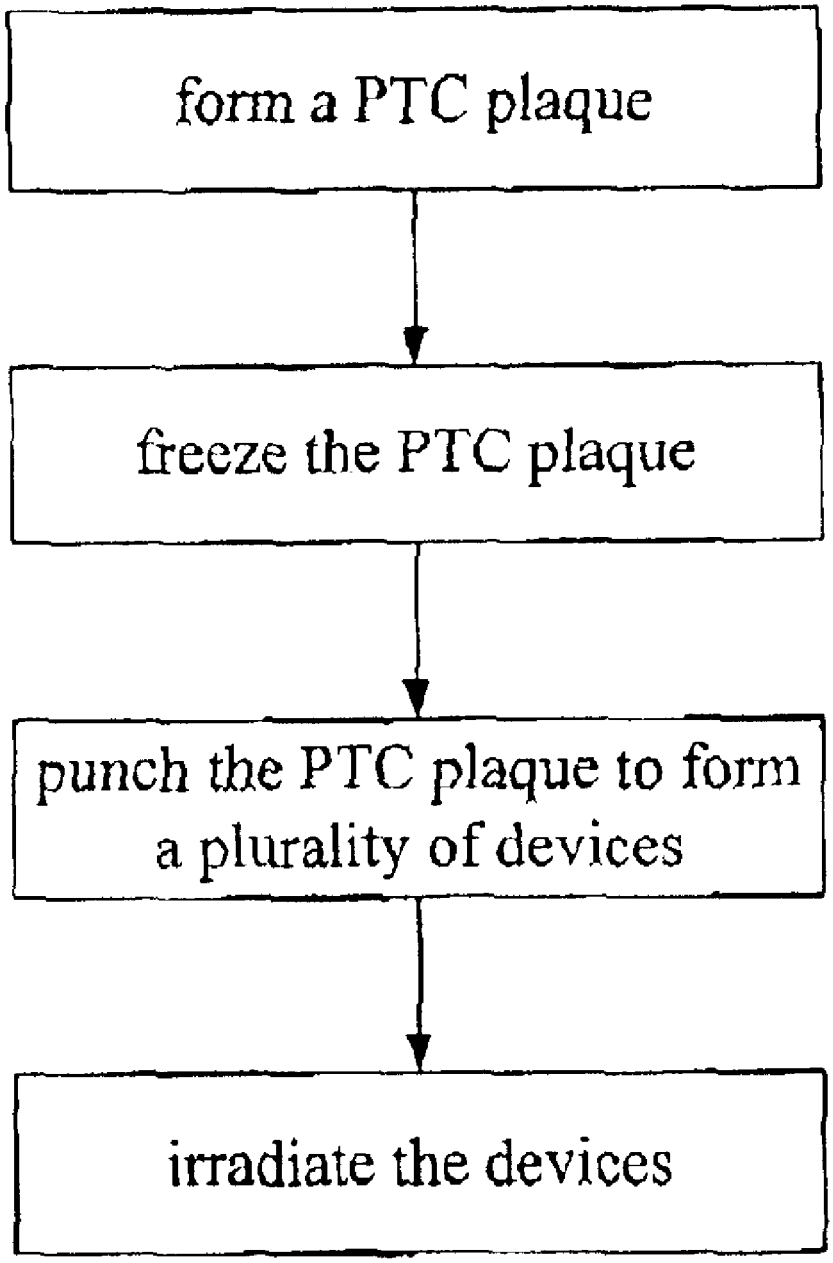
FIG. 2 shows a flow diagram of a first embodiment according to the invention.

FIG. 2 shows the flow chart of the manufacturing method of the over-current protection device according to a preferred embodiment of the invention. First, the PTC conductive composite material acting as the current sensing element 11 is pressed along with two metal foils 12 and 13 to form a PTC plaque. The material of the metal foil may be Ni, Cu or the alloy thereof, which is used as the electrode of the over-current protection device 10 after punching. The pressing process may be achieved by injecting the melted PTC conductive composite material 11 between the two metal foils 12 and 13 by extrusion, or may be formed by hot-pressing the conductive composite material 11 and the two metal foils 12 and 13.

Thereafter, the PTC plaque is cooled below 0° C., preferably below −30° C. The PTC plaque can then be punched under frozen state so as to avoid the high temperature of the PTC plaque during punching, which will generate the stress due to the difference of thermal expansion coefficient between the materials, and further reduces the temperature sensitivity or electrical property stability of the over-current protection device.

After punching, the temperature of the formed over-current protection device will return to room temperature. Then, the over-current protection device is irradiated with radioactive rays to make the PTC conductive composite material conduct cross-linking reaction for enhancing the thermal stability and electrical property stability of the over-current protection device.

Figure 3:
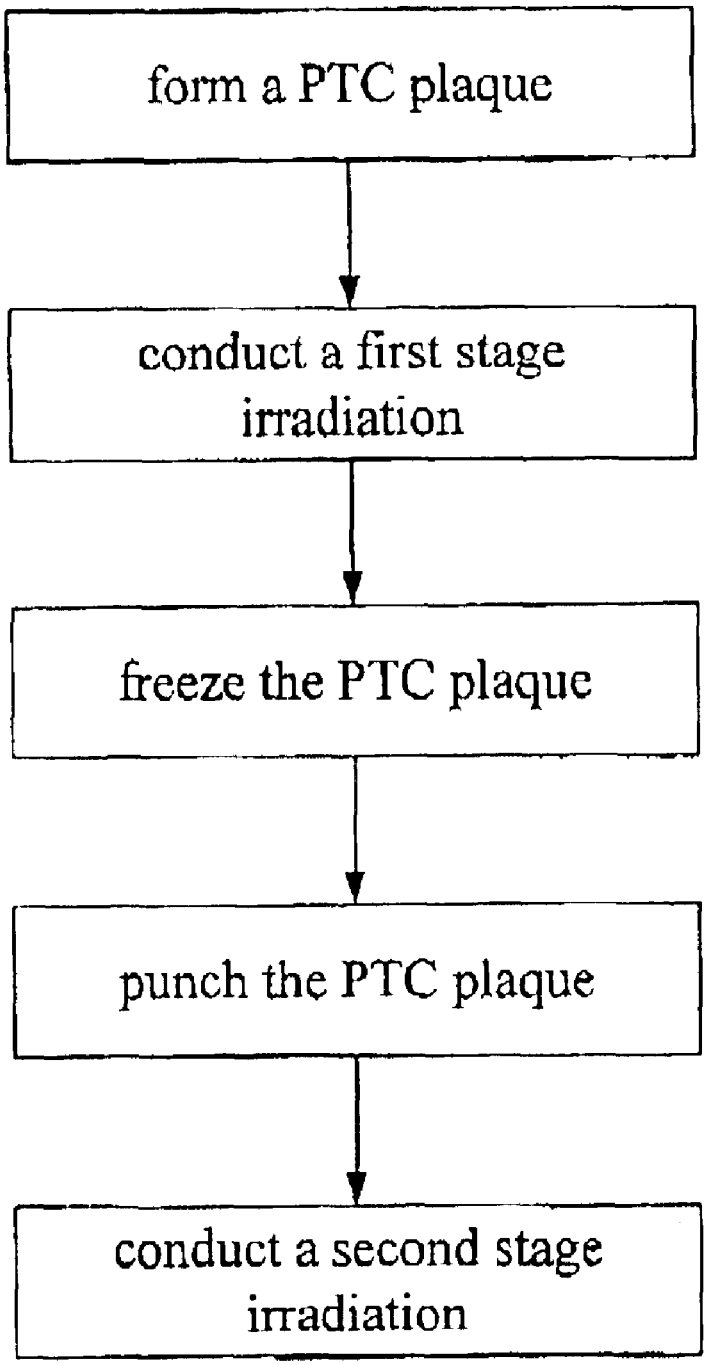
FIG. 3 shows a flow diagram of a second embodiment according to the invention.

FIG. 3 shows the flow chart of the manufacturing method of the over-current protection device according to another preferred embodiment of the invention, which uses two-stage radioactive rays irradiation to make the PTC conductive composite material conduct the cross-linking reaction. That is, before the PTC plaque is conducted by freezing, the first stage of radioactive rays irradiation is conducted first, which makes the PTC conductive composite material conduct an initial cross-linking reaction. After a plurality of over-current protection devices are formed by punching the PTC plaque, the second stage of radioactive rays irradiation is conducted, which makes the PTC conductive composite material conduct a further cross-linking reaction for increasing the thermal stability of the over-current protection device.

The above-described embodiments of the present invention are intended to be illustrative only. Numerous alternative embodiments may be devised by those skilled in the art without departing from the scope of the following claims.

What is claimed is:

1. A manufacturing method of over-current protection devices, comprising the steps of:

providing a PTC plaque including a conductive composite material with positive temperature coefficient and two metal foils;

cooling the PTC plaque to a frozen state below 0° C.; cutting the PTC plaque under the frozen state to form a plurality of over-current protection devices; and irradiating the over-current protection devices with radioactive rays to make the conductive composite material conduct a cross-linking reaction.

2. The manufacturing method of claim 1, wherein the conductive composite material includes a polymer and conductive filler.

3. The manufacturing method of claim 2, wherein the polymer is selected from the group consisting of polyethylene, polypropylene, polyoctenylene and the mixture thereof.

4. The manufacturing method of claim 2, wherein the conductive filler is selected from the group consisting of carbon black, metal particles, graphite, ceramic powder and the mixture thereof.

5. The manufacturing method of claim 1, wherein the PTC plaque is cooled below −30° C.

6. A manufacturing method of over-current protection devices, comprising the steps of:

providing a PTC plaque including a conductive composite material with positive temperature coefficient and two metal foils;

conducting a first stage irradiation to make the PTC conductive composite material conduct an initial cross-linking reaction;

cooling the PTC plaque to a frozen state below 0° C.;

cutting the PTC plaque under the frozen state to form a plurality of over-current protection devices; and conducting a second stage irradiation to make the PTC conductive composite material conduct further cross-linking reaction.

7. The manufacturing method of claim 6, wherein the conductive composite material includes a polymer and conductive filler.

8. The manufacturing method of claim 7, wherein the polymer is selected from the group consisting of polyethylene, polypropylene, polyoctenylene and the mixture thereof.

9. The manufacturing method of claim 7, wherein the conductive filler is selected from the group consisting of carbon black, metal particles, graphite, ceramic powder and the mixture thereof.

10. The manufacturing method of claim 6, wherein the PTC plaque is cooled below −30° C.

* * * * *